United States Patent [19]

Goldstein

[11] Patent Number: 4,594,816

[45] Date of Patent: Jun. 17, 1986

[54] UNIVERSAL HINGE-TYPE JOINT

[75] Inventor: Edward J. Goldstein, Minneapolis, Minn.

[73] Assignee: Padco, Inc., Minneapolis, Minn.

[21] Appl. No.: 768,184

[22] Filed: Aug. 23, 1985

Related U.S. Application Data

[63] Continuation of Ser. No. 653,471, Sep. 20, 1984, abandoned, which is a continuation of Ser. No. 356,925, Mar. 10, 1982, abandoned.

[51] Int. Cl.[4] ..... B24D 15/00

[52] U.S. Cl. ..... 51/393; 51/205 R; 16/225; 16/DIG. 13; 403/220; 403/291; 15/143 R; 15/209 R; 15/244 A

[58] Field of Search ..... 51/180, 205 R, 358, 51/391, 392, 393; 15/143 R, 209 R, 244 A; 16/225, 226, 227, 367, DIG. 13; 308/2 A; 403/220, 291

[56] References Cited

U.S. PATENT DOCUMENTS

| | | | |
|---|---|---|---|
| 504,452 | 9/1893 | Lewis . | |
| 763,100 | 6/1904 | Howell . | |
| 1,100,684 | 6/1914 | Stoakes | 16/367 |
| 1,124,400 | 1/1915 | Edwards | 16/367 |
| 2,694,857 | 11/1954 | Koval | 30/47 |
| 2,699,602 | 1/1955 | Finley | 30/47 |
| 2,722,031 | 11/1955 | Bressler | 15/201 |
| 3,332,255 | 7/1967 | Seagreaves et al. | 64/11 |
| 3,340,556 | 9/1967 | Allen | 15/159 |
| 3,369,268 | 2/1968 | Burns et al. | 15/210 |
| 3,374,498 | 3/1968 | Bailey | 15/119 |
| 3,395,416 | 8/1968 | Hughes | 15/228 |
| 3,449,786 | 6/1969 | Ross | 15/257.7 |
| 3,483,662 | 12/1969 | Ames | 15/392 |
| 3,597,938 | 8/1971 | Hellen et al. | 308/2 A X |
| 3,717,896 | 2/1973 | Chase et al. | 15/210 |
| 3,720,976 | 3/1973 | Bailey | 15/244 |
| 3,750,280 | 8/1973 | LePaliscot et al. | 30/85 |
| 3,768,110 | 10/1973 | Johnson et al. | 15/144 |
| 3,778,860 | 12/1973 | Thielen | 15/147 |
| 3,820,187 | 6/1974 | Numbers et al. | 15/244 |
| 4,038,716 | 8/1977 | Polsfuss | 15/230 |
| 4,127,911 | 12/1978 | Cupp et al. | 15/210 |
| 4,134,173 | 1/1979 | Cupp et al. | 15/210 |
| 4,155,140 | 5/1979 | Janssen et al. | 15/210 |
| 4,194,852 | 3/1980 | Cupp et al. | 403/299 |
| 4,204,295 | 5/1980 | O'Connor | 15/209 |
| 4,296,524 | 10/1981 | Horholt et al. | 16/DIG. 13 X |

FOREIGN PATENT DOCUMENTS

| | | | |
|---|---|---|---|
| 2517078 | 10/1976 | Fed. Rep. of Germany | 16/DIG. 13 |
| 1411175 | 8/1965 | France . | |
| 7922285 | 9/1979 | France . | |
| 2453721 | 9/1979 | France . | |
| 54569 | 10/1934 | Norway | 16/367 |
| 2051219 | 9/1979 | United Kingdom . | |

*Primary Examiner*—Robert P. Olszewski
*Attorney, Agent, or Firm*—Kinney & Lange

[57] ABSTRACT

A universal living hinge joint includes an integral, preferably molded, body having first and second ends fixedly attached to first and second implement members, connecting the implement members to each other. The integral body has a plurality of substantially rigid sections and a plurality of flexible portions of reduced thickness defining non-parallel axes of rotation which separate and connect the rigid sections to each other. The integral body is bendable along each of the flexible portions permitting rotation of the second implement member in a wide range of angular positions with respect to the first implement member.

21 Claims, 9 Drawing Figures

UNIVERSAL HINGE-TYPE JOINT

This is a continuation of application Ser. No. 653,471, filed Sept. 20, 1984 (now abandoned), which was a Continuation of application Ser. No. 356,925, filed Mar. 10, 1982 (now abandoned).

BACKGROUND OF THE INVENTION

1. Field of the Invention

The present invention relates to joints. In particular, it relates to joints that connect implement members allowing movement of one of the implement members in a plurality of planes.

2. Description of the Prior Art

The ability to use an implement in a variety of angular positions is quite important. However, most implements typically have the functional portion of the implement rigidly attached to the handle thereby limiting the use of the implement or resulting in an ackward use of the implement. For example, in a sanding tool, a handle is rigidly attached to a sanding tool pad. In the course of sanding drywall using an extension handle, there arise many situations in which the sanding tool has to be held in an awkward position in order to properly sand the surface of the drywall.

In the prior art, there have been various attempts to solve the problem of positioning an implement in an angular position. For the most part, the solutions have been bulky and cumbersome joints that include several distinct parts that slidably engage each other. These types of joints are difficult to assemble and costly to produce, increasing the cost of the implement substantially. In addition, several parts slidably engaging each other eventually wear out over time, break or bind. Some examples of these joints are set forth in the patents briefly described below.

The Bailey U.S. Pat. No. 3,720,976 shows a toilet brush having a ball joint pivotally connecting the handle to the brush. A ball joint, of course, is an expensive type of joint and is not suitable for application in a wide variety of implements.

The Johnson et al. U.S. Pat. No. 3,768,110 shows a swivel mop head having a single continuous serpentine slot disposed through a mid-portion of the body of the mop head. The portions of the mop head defined by parallel portions of the serpentine slot are capable of flexing upwardly and downwardly and angularly, providing the mop with the capability of being used in various angular positions. However, this type of joint would be quite difficult to apply to a smaller implement.

Several other examples of various joints for large implements, such as mops, brooms, toilet brushes and scrubbers are discussed in the following patents:

| Inventor | U.S. Pat. No. |
|---|---|
| Howell | 763,100 |
| Lewis | 504,452 |
| Allen | 3,340,556 |
| Ames | 3,483,662 |
| Bailey | 3,374,498 |
| Thielen | 3,778,860 |
| Numbers et al | 3,820,187 |
| O'Connor | 4,204,295 |

A smaller implement having a joint is shown in the Burns et al. U.S. Pat. No. 3,369,268. A paint applicator includes a handle that is movable in one angular direction with respect to the applicator. Although the handle is movable with respect to the paint applicator, the movement is limited to just one direction.

In the Polsfuss U.S. Pat. No. 4,038,716 a paint roller is disclosed that is rotatably mounted to an axle. A handle, in turn, is pivotally attached to the axle, permitting pivotal movement in an angular direction within one plane. Again, the movment between the handle and the roller is limited to one direction in a plane.

SUMMARY OF THE INVENTION

The present invention includes a universal hinge-type joint for use in connecting a first and second implement member to each other, such as a sanding tool pad to a handle of a sanding tool. The joint includes an integral body having a first end connected to the first implement member and a second end connected to the second implement member. A plurality of substantially rigid sections are defined by at least two flexible portions of reduced thickness defining non-parallel axes of rotation. The rigid sections are bendable along the flexible portions in a plurality of planes allowing rotation of the second implement member in a plurality of angular positions with respect to the first implement member.

Preferably, the integral body is substantially flat and the flexible portions include first and second score lines which bisect each other in a central portion of the flat body to form an "X" configuration and four rigid sections. Two of the four rigid sections positioned on opposite sides of the "X" configuration include the ends which are fixedly attached to the first and second implement members.

More preferably, a third score line is also provided which intersects the first and second score lines. In one embodiment the third score line is positioned between the "X" configuration of the second and third score lines and the first end which is fixedly attached to the first implement member such that the flat body is additionally bendable along the third score line. Alternatively, the third score line is positioned to bisect the point of intersection of the second and third score lines and to bisect the other two rigid sections that are not attached to the first and second implement members into an additional four rigid sections.

DETAILED DESCRIPTION OF THE PREFERRED EMBODIMENTS

Figure 1:
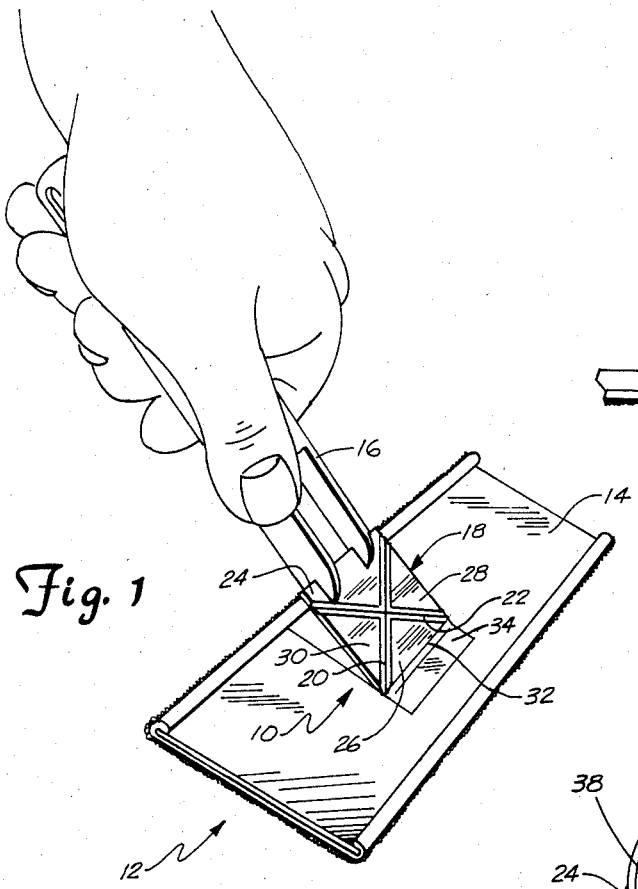
FIG. 1 is a perspective view of a preferred embodiment of the universal hinge-type joint of the present invention in use in a sanding tool.

The universal hinge-type joint of the present invention, generally indicated at 10, is illustrated in a preferred use in a sanding tool 12 in FIG. 1. To more clearly describe the present invention, like reference characters will be used to indicate like elements throughout the figures. The sanding tool 12 includes a suitable sanding pad 14 and a handle 16. The joint 10 connects the pad 14 to the handle 16.

The joint 10 includes a preferred substantially flat body 18 and first and second score lines 20, 22, defining flexible portions. The score lines, 20, 22 bisect each other in a central portion of the flat body 18, dividing the flat body 18 into four discrete substantially rigid sections 24, 26, 28 and 30. The score lines 22, 20 are a reduced thickness and sufficiently deep to allow bending of the flat body 18 along the score lines. The substantially rigid sections 24, 26, 28 and 30 provide sufficient support for motive force to be transmitted from the handle 16 to the pad 14.

Figure 2:
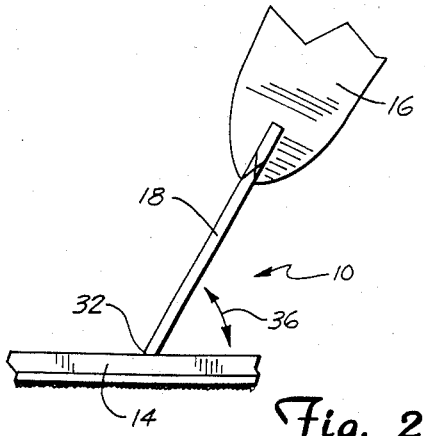
FIG. 2 is a side elevational view of the joint in the sanding tool.

Preferably, a third score line 32 is positioned between the rigid section 26 and the pad 14 defining a connecting section 34 which is fixedly attached to the pad 14. The third score line 32 is also sufficiently deep to allow bending of the flat body 18 along the direction of arrow 36, as illustrated in FIG. 2.

The joint 10 is a unitary joint preferably made of a suitable plastic material, such as polypropylene, that allows repeated bending along the score lines 20, 22 and 32 without breaking. The score lines are disposed on both sides of the flat body and are produced by a suitable "scoring" process, or alternatively, are formed simultaneously with the flat body by suitable molding or stamping processes.

Figure 3:
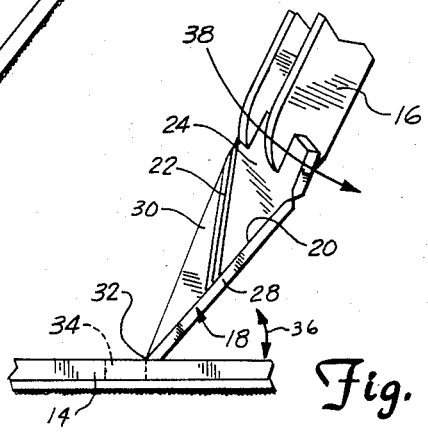
FIG. 3 is a perspective view of the hinge-type joint rotated in one direction.
Figure 4:
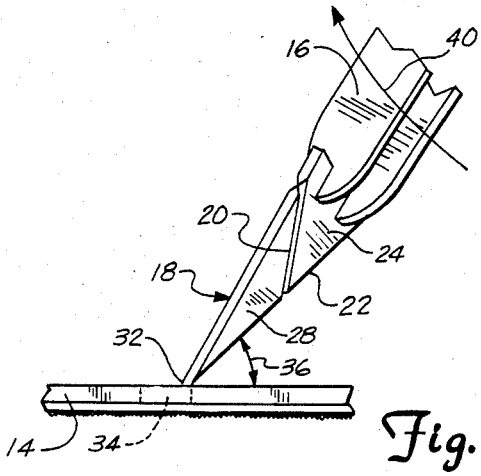
FIG. 4 is a perspective view of the hinge-type joint rotated in a direction opposite to that shown in FIG. 3.

The movement of the universal hinge-type joint of the present invention is more fully illustrated in FIGS. 3 and 4. In FIG. 3, the handle 16 is rotated along its axis in a direction of arrow 38 and along arrow 36, thereby bending the main body along score lines 20 and 32. When the handle 16 is rotated in a direction of arrow 40 and arrow 36, as illustrated in FIG. 4, the main body 18 is bent along score lines 22 and 32. As is easily understood from the above, the rigid sections 24, 26, 28 and 30 of the main body 18 are bendable along the score lines in a plurality of planes permitting the use of the sanding tool in a wide range of angular positions. The rigid sections are rotatable along axes defined by the score lines which are non-parallel to each other and to a major axis defined by the handle 16 and the body 18 when in a non-rotated position. The universal hinge-type joint is adaptable for use with a wide variety of implements and not restricted to just sanding tools.

A preferred alternative embodiment of the universal hinge-type joint of the present invention is illustrated in FIGS. 5–9.

Figure 5:
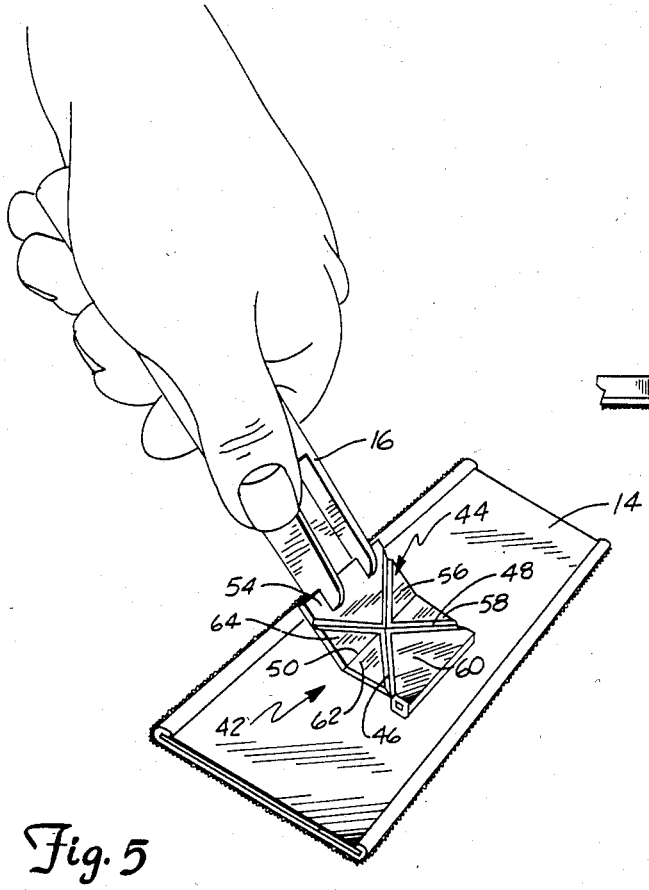
FIG. 5 is a perspective view of another preferred embodiment of the hinge-type joint in use in a sanding tool.
Figure 6:
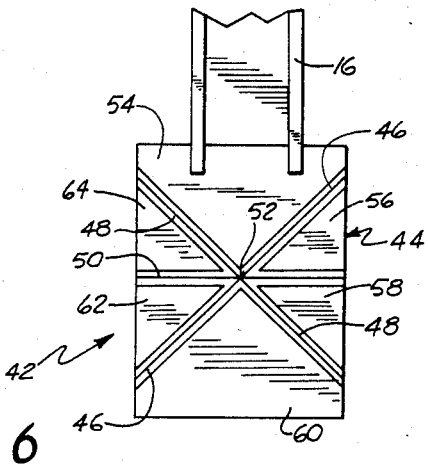
FIG. 6 is an enlarged fragmentary top plan view of the embodiment of FIG. 5 of the hinge-type joint.

In FIGS. 5 and 6, the alternative embodiment of the universal hinge-type joint is generally indicated at 42. The joint 42 similarly has a substantially flat body 44 which is attached at one end to the handle 16 of the sanding tool and to the pad 14 at another end. The joint 42 is similarly constructed with first and second score lines 46, 48 bisecting each other in a central portion of the flat body 44. A third score line 50 is positioned in the flat body 44 such that the third score line bisects the score lines 46, 48 at their point of intersection 52. Consequently, the score lines 46, 48 and 50 define substantially rigid sections 54, 56, 58, 60, 62 and 64. The rigid section 54 is fixedly attached to the handle 16 and the rigid section 60 is fixedly attached to the pad 14. The score lines 46, 48 and 50 are sufficiently deep such that the main body is bendable along the score lines with the rigid sections providing sufficient beam strength to the joint 42 for motive force to be transmitted from the handle 16 to the pad 14 for sanding.

Figure 7:
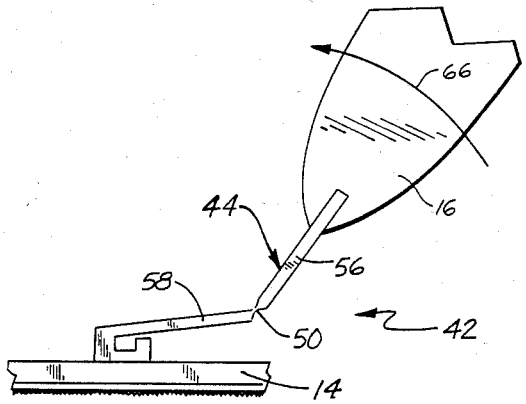
FIG. 7 is a side elevational view of the embodiment illustrated in FIG. 5.
Figure 8:
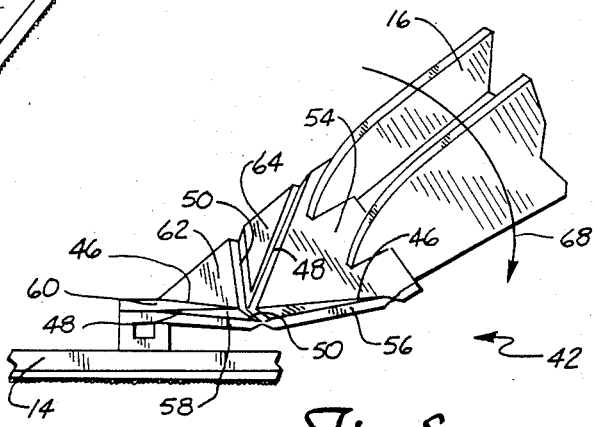
FIG. 8 is a perspective view of the preferred embodiment illustrated in FIG. 5 rotated in one direction.
Figure 9:
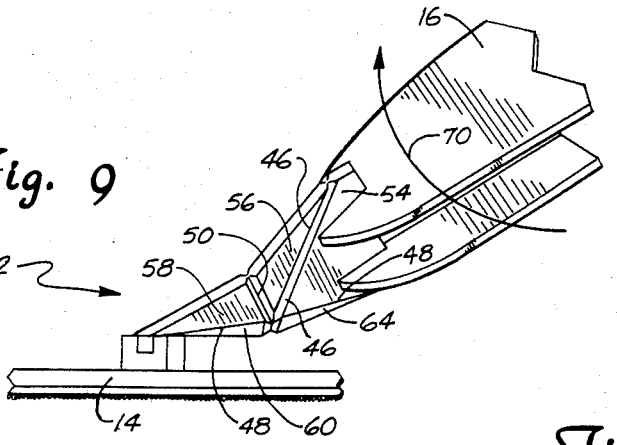
FIG. 9 is a perspective view of the preferred embodiment illustrated in FIG. 5 rotated in a direction opposite to that shown in FIG. 8.

The movement of the preferred embodiment shown in FIGS. 5 and 6 is illustrated in FIGS. 7 through 9. As illustrated in FIG. 7, the joint 42 is bendable along score line 50 in a direction of arrow 66 in a wide angular range. In FIG. 8, the joint 42 allows the handle 16 to be rotated along its axis in a direction of arrow 68 for use in a wide range of angular positions. Alternatively, the handle 16 may be rotated in an opposite direction as indicated by arrow 70 in FIG. 9. Although the joint 42 is bendable in a plurality of planes allowing use of the sanding tool in a wide range of angular positions, the rigid sections 54, 56, 58, 60, 62 and 64 provide sufficient beam strength such that motive force is transmitted from the handle 16 to the pad 14 for easy sanding of a drywall or other surface.

Another alternative embodiment (not shown) of the present invention includes a joint of substantial thickness. The joint is bendable along flexible portions of reduced thickness which define the rigid sections of the joint. The flexible portions are preferably V-shaped notches. A pair of V-shaped notches, located on opposite sides of the body, project inwardly into the body of the joint and form a flexible portion. A second pair of V-shaped notches is located in a non-parallel relationship to the previous pair of notches for forming a second flexible joint. Preferably, the two flexible portions are located such that their axis of rotation are substantially perpendicular to each other. Other V-shaped notches may be added to form more flexible portions which increase the angular range of rotation of the joint.

The present invention is not limited to sanding tools but may be included in a wide variety of implements including such implements as paint applicators. In addition, a larger embodiment of the hinge is usable, for example, in toilet bowl brushes, mops and other implements that are slid along a surface. Further, alternative embodiments of the present invention can be used to transmit power such as in a power train of small motors and in small tools where the transfer of power in an angular direction is desired.

CONCLUSION

The universal hinge-type joint of the present invention is a significant improvement over prior art joints for permitting use of implements in various angular positions. First, the joint is an integral unit, less prone to failure over time, and very inexpensive to manufacture. Second, the joint being made of a light plastic material does not significantly add to the weight of the implement. Third, the joint is adaptable for use in a great variety of implements, permitting use of such implements in a wide range of angular positions.

Although the present invention has been described with reference to preferred embodiments, workers skilled in the art will recognize that changes may be made in form and detail without departing from the spirit and scope of the invention. For example, although the fixed attachments of joints 10 and 42 to handle 10 and to the pad were illustrated as permanent bonds, the present invention is equally applicable to tools in which a releasable connection is made between the joint and either the handle or the tool head, or both. This releasable connection may, for example, be in the form of a snap lock connector, part of which is carried by the joint and the other part of which is carried by the member to which the joint is connected.

What is claimed is:

1. A flexible force transmitting joint in combination with a first implement member and a second implement member, the joint comprising:

an integral body having a first end for connection to the first implement member and a second end for connection to a second implement member; having a plurality of substantially rigid sections; and having first, second and third flexible portions defining non-parallel axes of rotation separating and flexibly connecting the rigid sections to each other, each of the axes of rotation intersecting a longitudinal central axis which extends between the first and second ends and intersecting the other axes of rotation, two of the axes being oriented diagonally with respect to the longitudinal central axis and intersecting each other in an "X" configuration and one of the axes being oriented essentially perpendicular to the longitudinal central axis, the body being bendable along the flexible portions to allow transmission of force from the second to the first implement member generally along the longitudinal central axis with the second implement member in a wide range of angular positions with respect to the first implement member, the flexible portions being positioned to permit bending simultaneously about multiple axes of rotation.

2. The joint of claim 1 wherein the integral body is made of a plastic material.

3. The joint of claim 1 wherein the flexible portions are first, second and third score lines.

4. The joint of claim 3 wherein the first and second score lines are oriented diagonally to intersect each other and the longitudinal central axis at a common intersection point proximate a central portion of the plate in the "X" configuration and define first, second, third and fourth substantially rigid sections.

5. The joint of claim 4 wherein the first and third rigid sections are on opposite ends of the "X" configuration and the third score line is positioned between the first rigid section and the first end.

6. A flexible force transmitting joint for connecting a tool with a handle to permit force to be transmitted from the handle to the tool, the joint comprising a plastic plate connected between the tool and the handle, the plate having a plurality of substantially rigid sections separated by first, second and third non-parallel intersecting score lines which extend transversely across the plate, at least two of the score lines being oriented to intersect each other in an "X" configuration, the plate being bendable simultaneously along multiple score lines to allow transmission of force from the handle to the tool with the handle in a wide range of angular positions with respect to the tool.

7. The joint of claim 6 wherein the first and second score lines are oriented diagonally to intersect each other at a common intersection point proximate a central portion of the flat body in the "X" configuration and define first, second, third and fourth substantially rigid sections.

8. The joint of claim 7 wherein the first and third rigid sections are on opposite ends of the "X" configuration and the third score line is positioned between the first rigid section and a first end of the plate.

9. The joint of claim 7 wherein the third score line is positioned to pass through the common intersection point and to bisect at least two rigid sections.

10. An implement comprising:

a functional implement member;

a handle;

a joint connected between the handle and the functional implement member in a variable angle force transmitting relationship, the joint comprising a body which defines a longitudinal central axis between the handle and the functional implement member; first and second flexible hinges oriented diagonally with respect to the longitudinal central axis and bisecting each other proximate a central portion of the body in an "X" configuration; and a third flexible hinge oriented essentially perpendicular to the longitudinal central axis and intersecting the first and second hinges for permitting simultaneous bending of the flat body about multiple hinge axes such that the handle member is movable to a plurality of angular positions with respect to the functional implement member in which force is transmitted from the handle to the functional implement member.

11. The implement of claim 10 wherein the first and second hinges comprise first and second diagonal score lines in the body.

12. The implement of claim 11 wherein the third flexible hinge comprises a third score line in the body.

13. The implement of claim 12 wherein the third score line is positioned to intersect the first and second score lines at a common intersection point.

14. A universal joint for connecting a first member and a second member in a variable angle force transmitting relationship, the universal joint comprising a body having a first end for connection to the first member, a second end for connection to the second member, and having a plurality of substantially rigid sections separated by first, second and third nonparallel intersecting score lines, the body defining a longitudinal central axis between its first and second ends, wherein each of the score lines intersects the longitudinal central axis, the body being bendable simultaneously about a plurality of independent axes defined by the intersecting score lines to allow a range of angular positions of the first member with respect to the second member in a plurality of planes; wherein the first and second score lines intersect to form an "X" configuration; and wherein the plurality of intersecting score lines includes a third score line which is essentially perpendicular to the longitudinal axis.

15. A force transmitting joint for connection between a first implement member and a second implement member, the joint having first, second and third flexible portions defining first, second, and third nonparallel intersecting axes of rotation, separating and flexibly connecting a plurality of substantially rigid sections to each other, each of the axes of rotation intersecting a longitudinal central axis of the plate and the first and second axes being oriented diagonally with respect to the longitudinal axis and crossing each other in an "X" configuration, the joint being bendable simultaneously along at least two of these first, second, and third axes in planes at least partially transverse to the longitudinal axis allowing an even and balanced force transmission with rotation of the second implement member to a wide range of angular positions with respect to the first implement member.

16. A flexible force transmitting joint for connecting a tool with a handle to permit force to be transmitted from the handle to the tool, the joint comprising a plastic plate connected between the tool and the handle, the plate having first and second side edges, a plurality of substantially rigid sections separated by at least six score line segments, three of the score line segments extending outwardly in nonparallel directions from a center area of the plate to the first side edge, and three of the score line segments extending outwardly in nonparallel directions from the center area of the plate to the second side edge of the plate to permit the plate to be bendable simultaneously along multiple score line segments to allow transmission of force from the handle to the tool with the handle in a wide range of angular positions with respect to the tool, and wherein the six score line segments all radiate outwardly from a common intersection area.

17. A flexible force transmitting joint in combination with a first implement member and a second implement member, the joint comprising:

an integral body having a first end for connection to the first implement member and a second end for connection to a second implement member; having a plurality of substantially rigid sections; and having first, second, third, fourth, fifth and sixth flexible segments separating and flexibly connecting the rigid sections to each other, each of the flexible segments extending generally radially from a common intersection area along a longitudinal central axis which extends between the first and second ends to an outer edge of the body, at least four of the flexible segments being oriented diagonally with respect to the longitudinal central axis, the body being bendable along the flexible segments to allow transmission of force from the second to the first implement member generally along the longitudinal central axis with the second implement member in a wide range of angular positions with respect to the first implement member, the first, second and third segments extending in nonparallel directions to a first side edge of the body and the fourth, fifth and sixth segments extending in nonparallel directions to a second side edge of the body, the flexible segments being positioned to permit bending simultaneously about multiple axes of rotation.

18. A flexible force transmitting joint for connecting a tool with a handle to permit force to be transmitted from the handle to the tool, the joint comprising a plastic plate connected between the tool and the handle, the plate having a plurality of substantially rigid sections separated by a at least six score line segments which radiate outwardly in radial directions from a common intersection area located generally in a center of the plate to outer edges of the plate to permit the plate to be bendable simultaneously along multiple score line segments to allow transmission of force from the handle to the tool with the handle in a wide range of angular positions with respect to the tool.

19. A universal joint for connecting a first member and a second member in a variable angle force transmitting relationship, the universal joint comprising a body having a first end for connection to the first member, a second end for connection to the second member, and having a plurality of substantially rigid sections separated by score line segments, the body defining a longitudinal central axis between its first and second ends and having, a common intersection area generally along the longitudinal central axis from which the score line segments radiate outwardly to outside edges of the body, at least three score line segments extending outwardly in nonparallel directions to a first side edge of the body and at least three score line segments extending outwardly in nonparallel directions to a second side edge of the body, the body being bendable simultaneously about a plurality of independent axes defined by the score line segments to allow transmission of force generally along the longitudinal central axis from the first member to the second member with the first member in a range of angular positions with respect to the second member.

20. A flexible force transmitting joint in combination with a first implement member and a second implement member, the joint comprising:

an integral body having a first end or connection to the first implement member and a second end for connection to a second implement member; having a plurality of substantially rigid sections; and having first, second and third flexible portions defining non-parallel axes of rotation separating and flexibly connecting the rigid sections to each other, each of the axes of rotation intersecting a longitudinal central axis which extends between the first and second ends, at least two of the axes being oriented diagonally with respect to the longitudinal central axis and at least two of the axes intersecting each other in an "X" configuration, the body being bendable along the flexible portions to allow transmission of force from the second to the first implement member generally along the longitudinal central axis with the second implement member in a wide range of angular positions with respect to the first implement member, the flexible portions being positioned to permit bending simultaneously about multiple axes of rotation;

wherein the flexible portions are first, second and third score lines;

wherein the first and second score lines are oriented diagonally to intersect each other and the longitudinal central axis at a common intersection point proximate a central portion of the plate in the "X" configuration and define first, second, third, and fourth substantially rigid sections; and wherein the third score line is positioned to pass through the common intersection point and to bisect at least two rigid sections.

21. The joint of claim 20 wherein the first implement member is a tool body and the second implement member is a handle.

* * * * *

UNITED STATES PATENT AND TRADEMARK OFFICE

CERTIFICATE OF CORRECTION

PATENT NO. : 4,594,816

DATED : June 17, 1986

INVENTOR(S) : Edward J. Goldstein

It is certified that error appears in the above-identified patent and that said Letters Patent is hereby corrected as shown below:

Column 1, line 20, "ackward" should be --awkward--.

Column 2, line 7, "movment" should be --movement--.

Column 4, line 35, "axis" should be --axes--.

Column 7, line 58, after "by" delete "a".

Column 8, line 28, "or" should be --for--.

Signed and Sealed this

Twenty-seventh Day of January, 1987

*Attest:*

DONALD J. QUIGG

*Attesting Officer*

*Commissioner of Patents and Trademarks*